US010148069B2

(12) United States Patent
Wolf et al.

(10) Patent No.: US 10,148,069 B2
(45) Date of Patent: Dec. 4, 2018

(54) POSITION ADJUSTMENT MECHANISM FOR A CORONA TREATMENT APPARATUS

(71) Applicant: Illinois Tool Works Inc., Glenview, IL (US)

(72) Inventors: Rory A. Wolf, Hartford, WI (US); Eric J. Urban, West Allis, WI (US); Robert A. Kleinschmidt, Hartford, WI (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 292 days.

(21) Appl. No.: 15/145,327

(22) Filed: May 3, 2016

(65) Prior Publication Data

US 2017/0324223 A1 Nov. 9, 2017

(51) Int. Cl.

| | |
|---|---|
| ***H01T 23/00*** | (2006.01) |
| ***H01T 19/00*** | (2006.01) |
| ***G21K 5/02*** | (2006.01) |

(52) U.S. Cl.

CPC ..... *H01T 19/00* (2013.01); *G21K 5/02* (2013.01)

(58) Field of Classification Search

CPC ..... H01T 19/00

See application file for complete search history.

(56) References Cited

U.S. PATENT DOCUMENTS 3,890,504 A * 6/1975 Pendleton ..... B29C 47/887 250/324
4,556,544 A 12/1985 Ahlbrandt
4,946,568 A 8/1990 Kalwar et al.
5,169,450 A * 12/1992 Opad ..... H01T 19/00 118/621
5,466,423 A 11/1995 Brinton et al.
6,007,784 A * 12/1999 Jorgensen ..... B01J 19/088 422/186.05

FOREIGN PATENT DOCUMENTS

| | | |
|---|---|---|
| DE | 2753711 A1 | 6/1979 |
| IT | 1266307 B1 | 12/1996 |
| JP | 9-255803 A | 9/1997 |

OTHER PUBLICATIONS

Office Action for corresponding Canadian Patent Application No. 2,951,304 dated Dec. 11, 2017.
Combined Search and Examination Report for corresponding Great Britain application No. GB1620973.6 dated May 17, 2017.
Abstract of DE2753711 (A1).
Abstract of IT1266307 (B1).
Abstract of JPH09255803 (A).

* cited by examiner

*Primary Examiner* — Stephen W Jackson
(74) *Attorney, Agent, or Firm* — Klintworth & Rozenblat IP LLP

(57) ABSTRACT

According to an aspect of the present disclosure, a position adjustment mechanism is provided for automatically adjusting the position of an electrode relative to a ground roller in a corona treatment apparatus. The position adjustment mechanism is capable of detecting thickened areas in a web of material that is being treated and automatically adjusting the air gap to maintain the quality of the surface treatment of the web.

18 Claims, 7 Drawing Sheets

POSITION ADJUSTMENT MECHANISM FOR A CORONA TREATMENT APPARATUS

FIELD OF THE INVENTION

The present invention relates generally to a position adjustment mechanism for adjusting the distance an electrode is spaced from a ground roller in a corona treatment apparatus.

BACKGROUND

Corona treatment is a method using an electrical corona discharge to modify a surface of a web to improve its ability to accept inks and adhesives. In a corona treatment, a high voltage electrode is mounted parallel to and spaced from a ground roller, which forms a grounded electrode. The air gap between the electrodes is energized, forming a corona, which, when web is passed therethrough modifies the material the web is formed of, and makes the web more receptive to ink and adhesives. Corona will be produced anywhere there is air within this air gap.

The web may have differing thicknesses, for example, if two pieces of the web are spliced together. As a result, the upper surface of the web at the splice will be closer to the high voltage electrode as it passes through the air gap. This may lead to undesirable results.

Currently, as the web is being passed through the air gap, the position of the electrode relative to the ground roller is manually adjusted. This is time consuming and can result in undesirable results.

SUMMARY

In one aspect, a position adjustment mechanism is provided. The position adjustment mechanism automatically adjusts the position of an electrode relative to a ground roller in a corona treatment apparatus. The position adjustment mechanism is capable of detecting thickened areas in a web of material that is being treated and automatically adjusting the air gap to maintain the quality of the surface treatment of the web.

The scope of the present invention is defined solely by the appended claims and is not affected by the statements within this summary.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION

Figure 1:
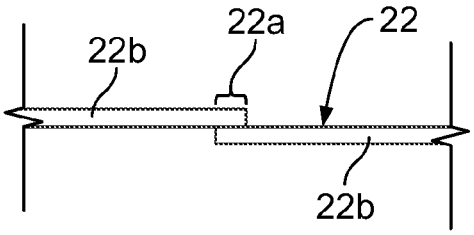
FIG. 1 depicts a side elevation view of a web material which can be used with the corona treatment apparatus of the present disclosure.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein. Therefore, unless otherwise noted, features disclosed herein may be combined together to form additional combinations that were not otherwise shown for purposes of brevity.

Figure 10:
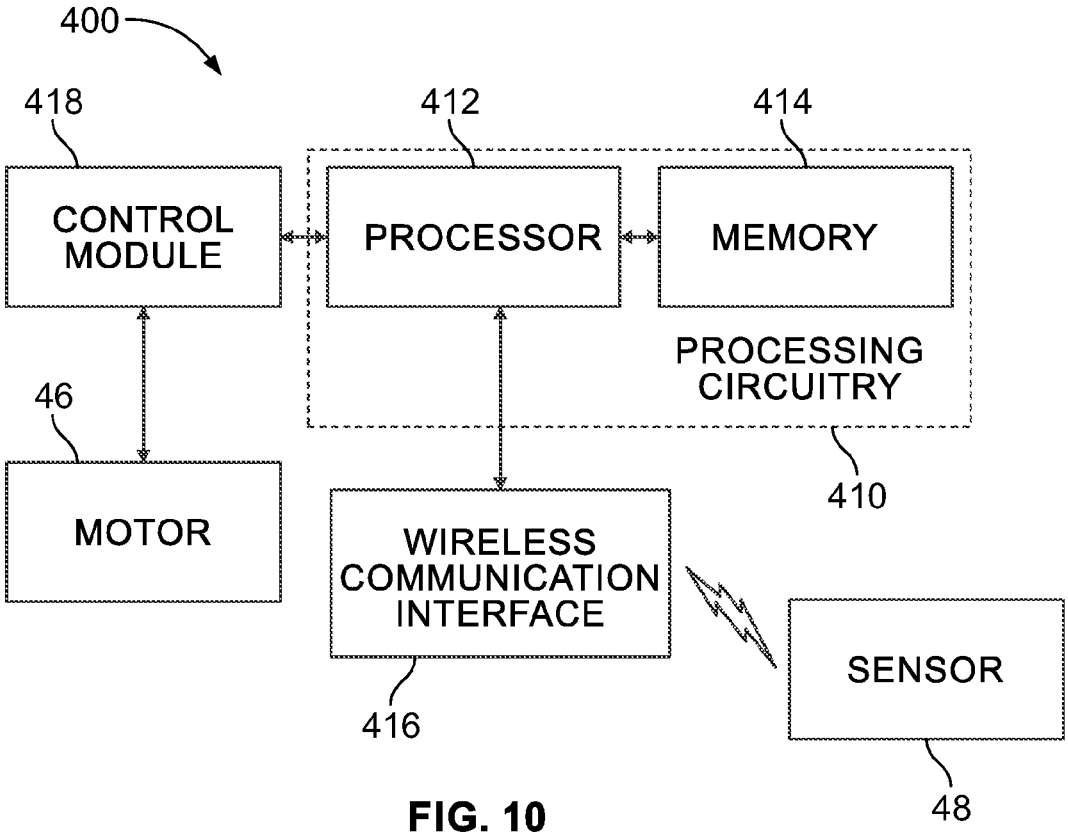
FIG. 10 depicts a block view of a control system.
Figure 2:
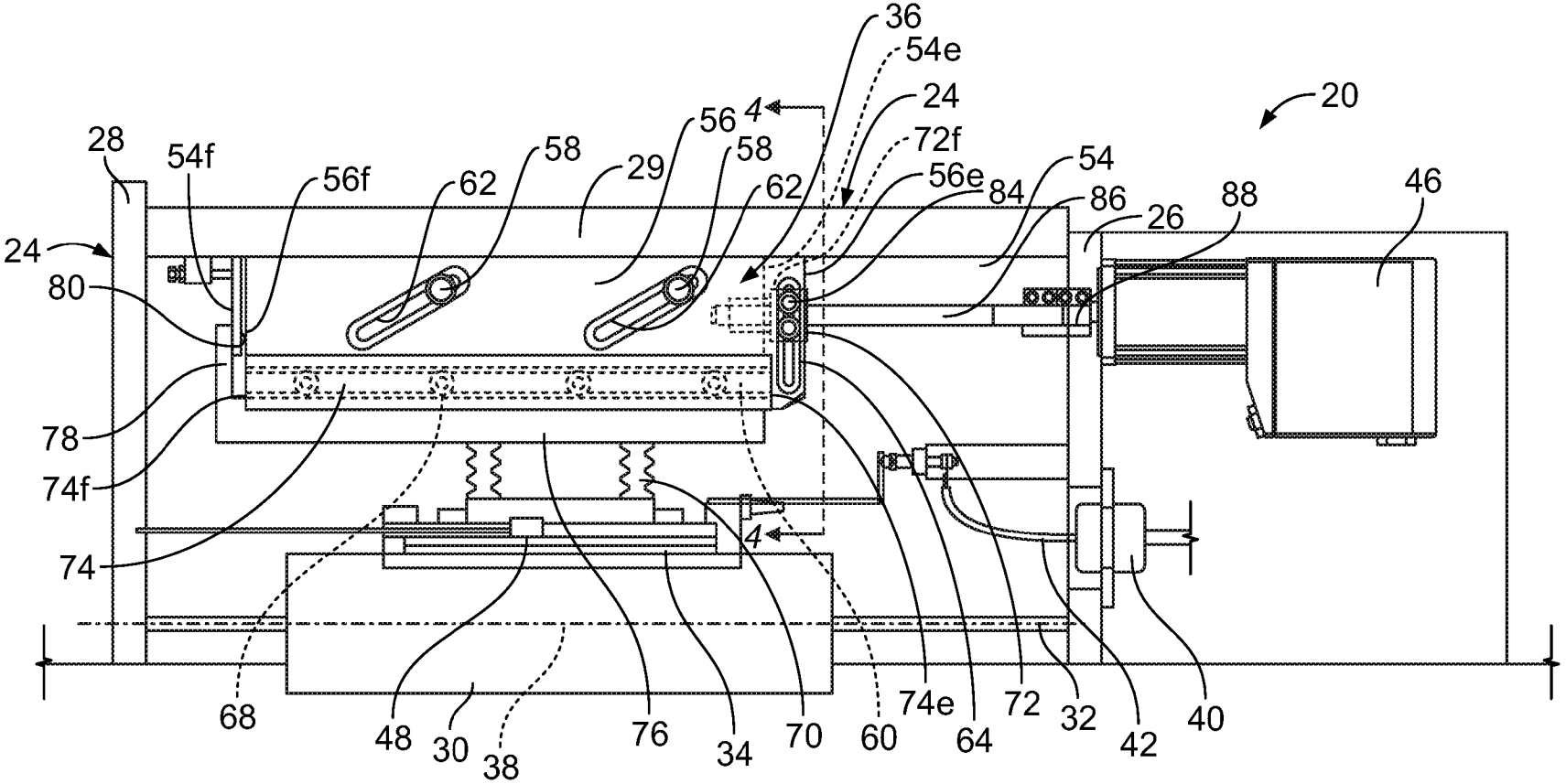
FIG. 2 depicts a side elevation view of the corona treatment apparatus according to a first embodiment and in a first position for use.
Figure 3:
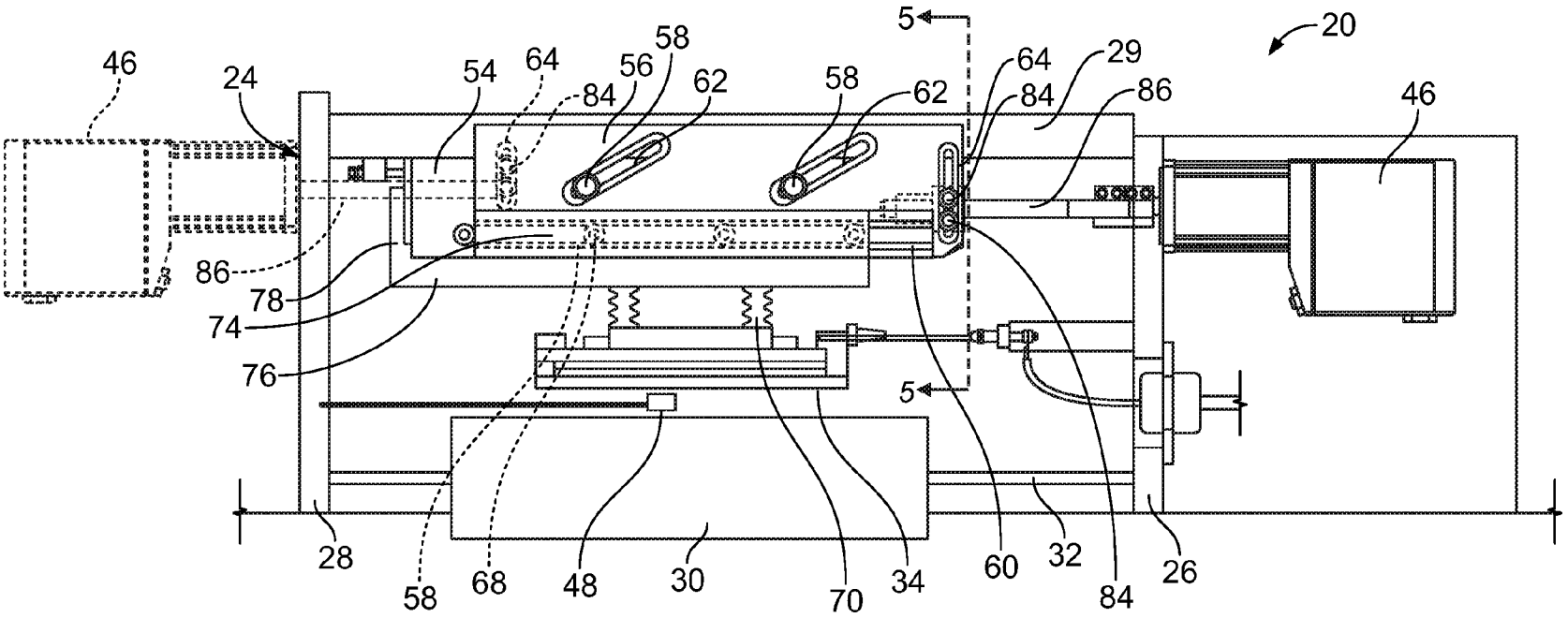
FIG. 3 depicts a side elevation view of the corona treatment apparatus of FIG. 2, and in a second position for use.
Figure 5:
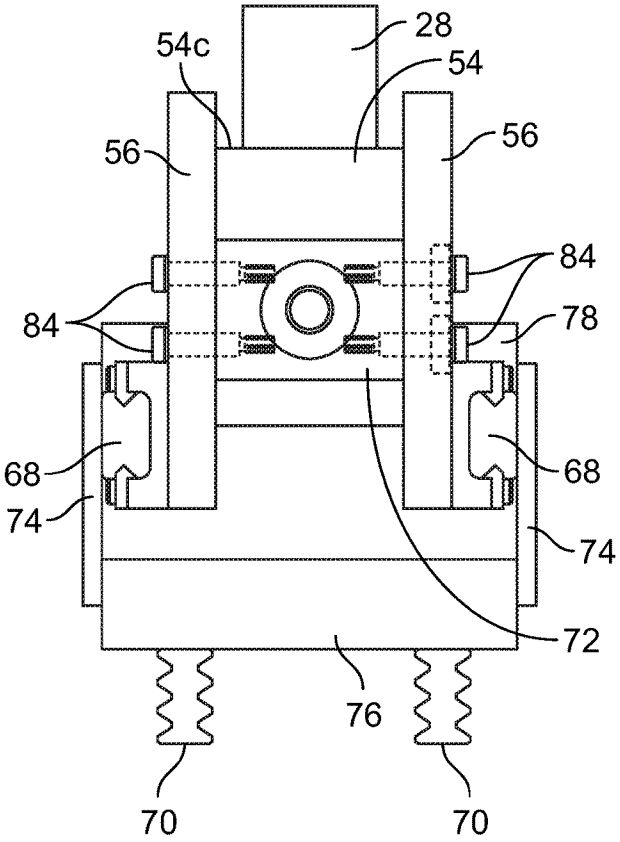
FIG. 5 depicts a cross-sectional view of the corona treatment apparatus along line 5-5 of FIG. 2.
Figure 4:
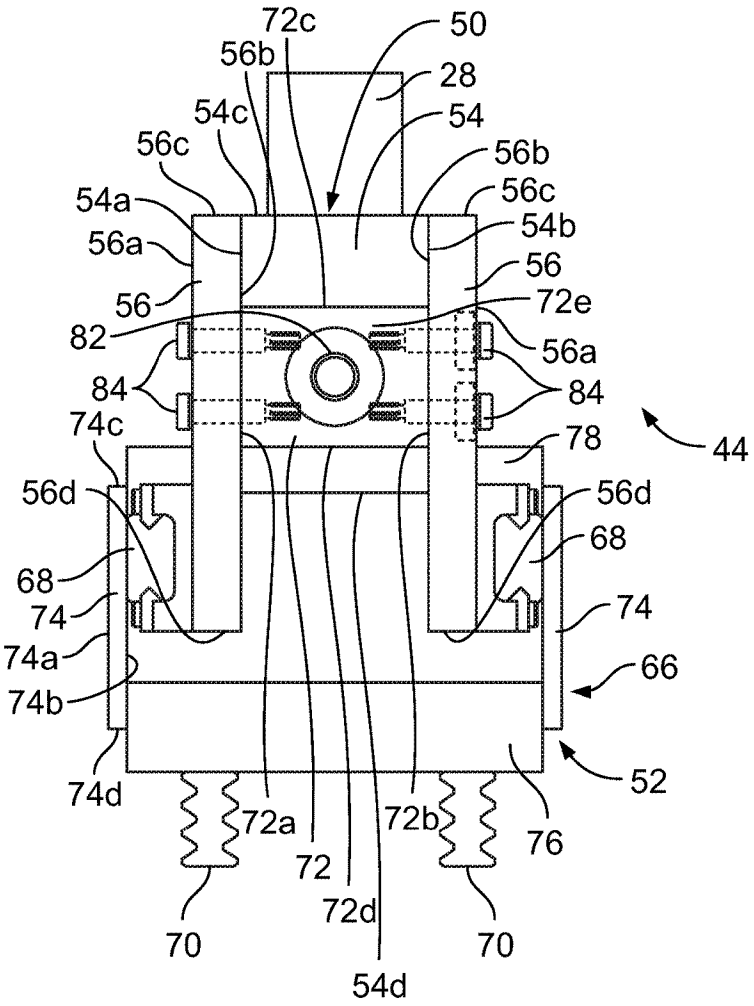
FIG. 4 depicts a cross-sectional view of the corona treatment apparatus along line 4-4 of FIG. 1.
Figure 6:
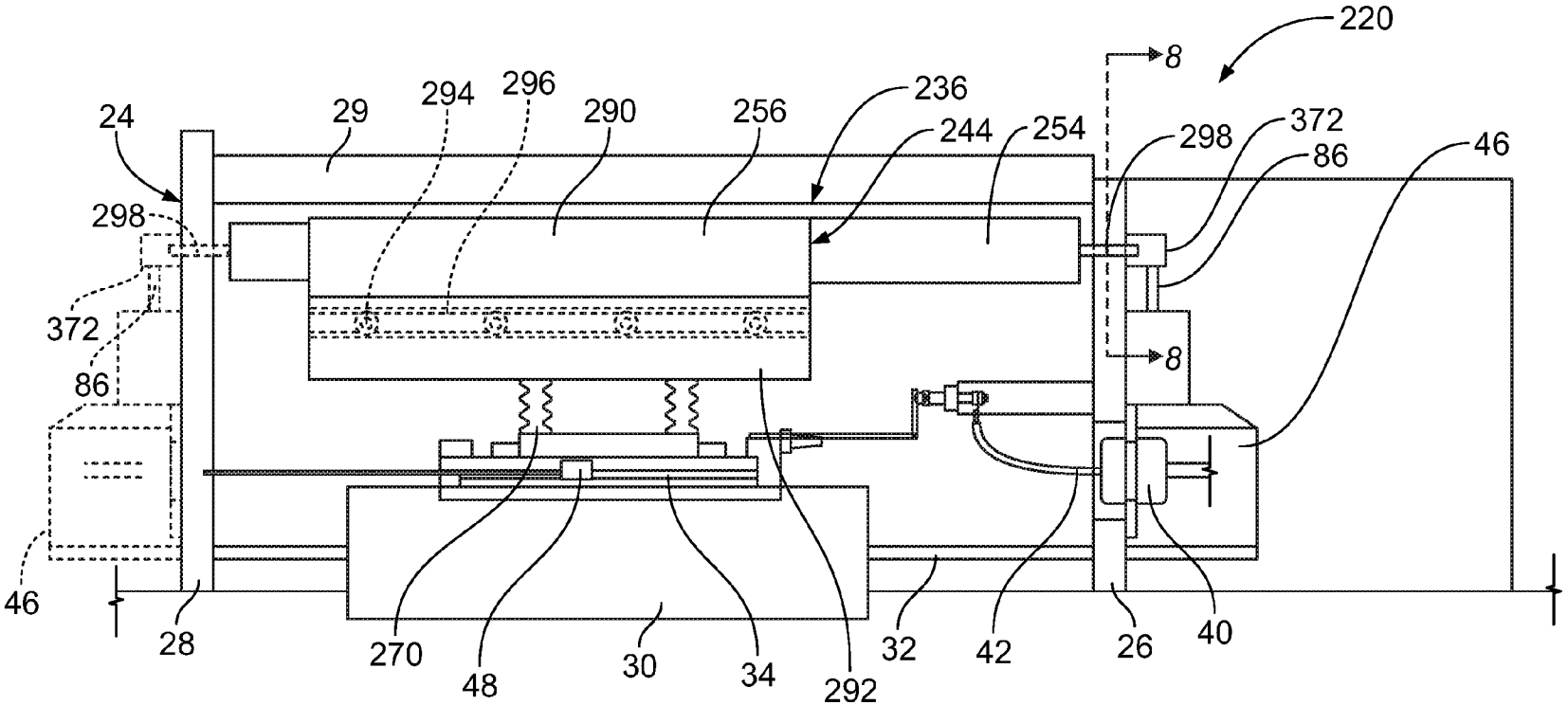
FIG. 6 depicts a side elevation view of the corona treatment apparatus according to a second embodiment and in a first position for use.
Figure 7:
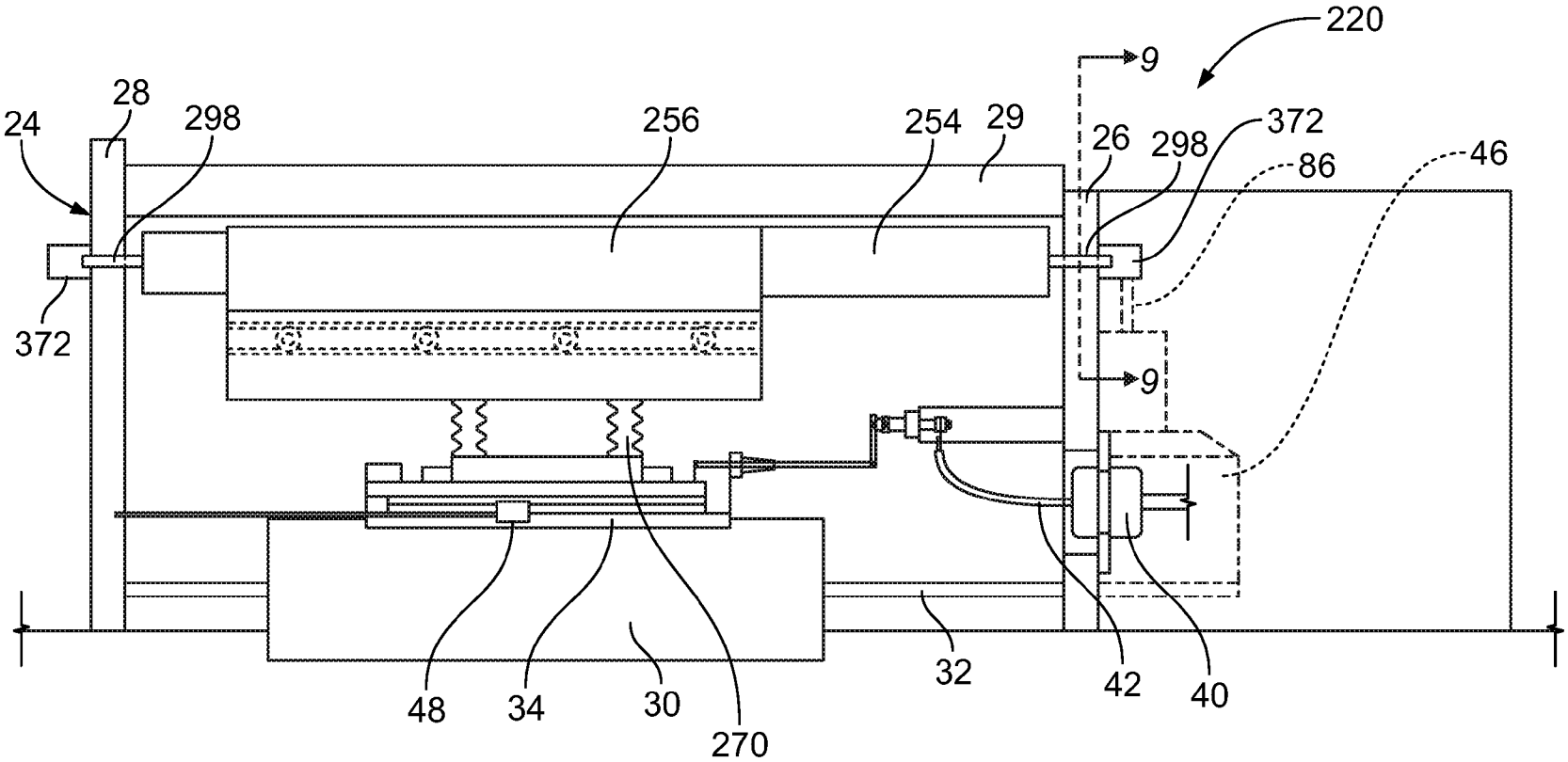
FIG. 7 depicts a side elevation view of the corona treatment apparatus of FIG. 6, and in a second position for use.
Figure 8:
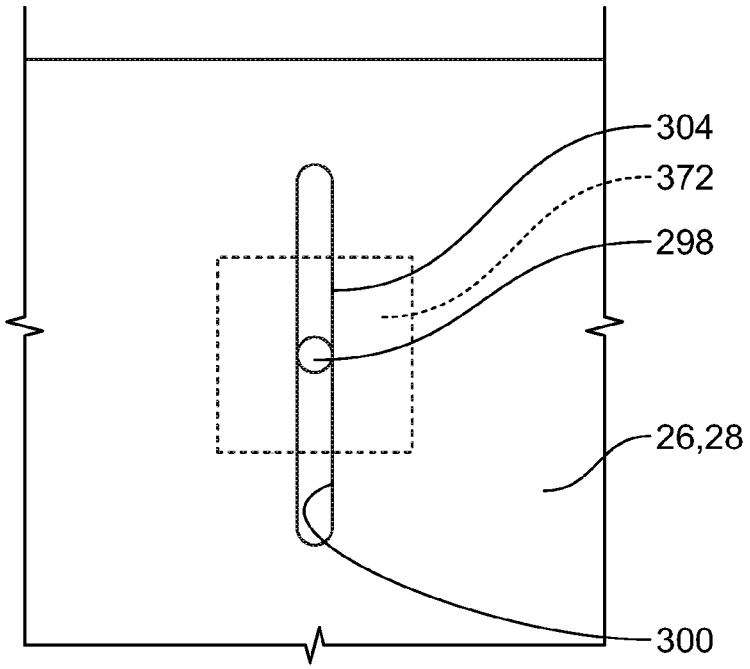
FIG. 8 depicts a cross-sectional view of the corona treatment apparatus along line 8-8 of FIG. 6.
Figure 9:
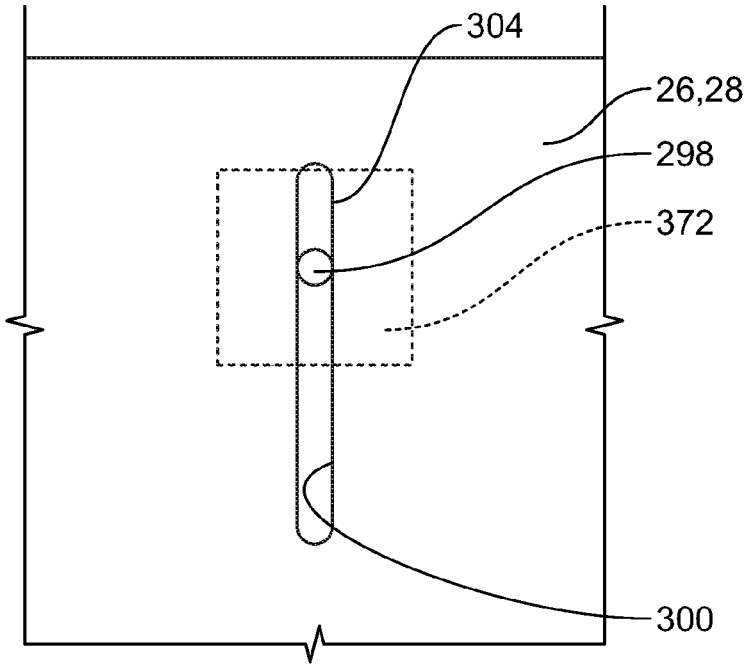
FIG. 9 depicts a cross-sectional view of the corona treatment apparatus along line 9-9 of FIG. 7.

The drawings illustrate a corona treatment apparatus 20, 220 which incorporates features of the present disclosure. The corona treatment apparatus 20, 220 is used to modify a surface of a flexible web 22 of material to improve its ability to accept inks and adhesives. Examples of webs 22 that may be treated by the corona treatment apparatus 20 include, but are not limited to, paper, polymer films, elastomers, plastics, foams, etc. The corona treatment apparatus 20, 220 may be adapted to be used in conjunction with a printing press (not shown). A first embodiment of the corona treatment apparatus 20 is shown in FIGS. 2-5, and a second embodiment of the corona treatment apparatus 220 is shown in FIGS. 6-9. A processing apparatus 400 used in operating the corona treatment apparatus 20, 220 is shown in FIG. 10.

In each embodiment, the corona treatment apparatus 20, 220 includes a frame 24 formed of a first end plate 26 and, in parallel relationship thereto, a second end plate 28 and a plurality of tie bars 29 extending between the end plates 26, 28. The corona treatment apparatus 20, 220 further includes a cylindrical ground roller 30 rotatably mounted on a shaft between the end plates 26, 28, a high voltage electrode 34 mounted proximate to the ground roller 30 by a position adjustment mechanism 36, 236 which is attached to the frame 24. The ground roller 30 has an axis 38 around which the ground roller 30 rotates. The electrode 34 is positioned proximate to, but spaced from, the ground roller 30 to form an air gap, for example an air gap having a width of 1.5 mm, through which the web 22 passes for treatment. The electrode 34 may span the length of the ground roller 30. A power supply and a high voltage transformer 40 are attached to the end plate 26 and is provided with a high voltage wire 42 for connection to the electrode 34. The high voltage connection establishes a high voltage field between the ground roller 30 and the electrode 34 with the web 22 to be treated interposed between the electrode 34 and the ground roller 30. As is well known, the high voltage field establishes a corona discharge that causes the chemical composition of the material of the web 22 to be modified which, in turn, improves selected characteristics of the material of the web 22 such as wettability so that printed matter or coating may be more advantageously adhered thereto.

The position adjustment mechanism 36, 236 is used to automatically adjust the distance the electrode 34 is spaced from the ground roller 30 as is described herein. Upon detection of a thickened area 22*a* of the web 22, the position adjustment mechanism 36, 236 automatically moves the electrode 34 to a proper distance from the surface of the web 22 being treated as the web 22 moves through the air gap, and upon detection of an unthickened area 22*b* of the web 22, the position adjustment mechanism 36, 236 automatically moves the electrode 34 to a proper distance from the surface of the web 22 being treated as the web 22 moves through the air gap. The thickened area 22*a* may be caused by a splice between adjacent pieces of the web 22. The thickened area 22*a* may be caused by inconsistencies in the thickness of the web 22.

Ground rollers used in a corona treatment apparatus are known in the art. The ground roller 30 may have a surface formed of steel, ceramic, rubber, etc. The ground roller 30 may be formed of a self-supporting tube of a rigid dielectric material, such as a glass fiber reinforced epoxy or a glass fiber reinforced polymeric polyester. A conductive layer may be bonded to an inner wall of the ground roller 30. The conductive layer is a relatively thin conductive metallic film or a coating containing a conductor, such as graphite. The conductive layer is relatively thin and does not have to be self-supporting because it is supported by the inner wall of the ground roller 30.

The electrode 34 may be a plurality of parallel electrodes; the electrode 34 may be a ceramic electrode, a FIN electrode, a segmented electrode, as is known in the art.

Attention is invited to the first embodiment of the corona treatment apparatus 20 shown in FIGS. 2-5 which includes the position adjustment mechanism 36.

The position adjustment mechanism 36 includes an electrode mount 44 which is connected to the frame 24, a motor 46 for moving the position of the electrode mount 44 relative to the frame 24, a sensor 48, and the processing apparatus 400 in communication with the sensor 48 and the motor 46. The motor 46 has a ball screw drive shaft 86 extending therefrom and in direction connection with the position adjustment mechanism 36. The electrode mount 44 is formed from a first assembly 50 and a second assembly 52.

The first assembly 50 includes a support 54 which is non-moveably attached to one of the tie bars 29 of the frame 24, a pair of spaced apart mounting plates 56 which are moveably connected to the support 54 and a plurality of pins 58 which are used to connect the mounting plates 56 to the support 54. The support 54 is mounted between the mounting plates 56. The support 54 forms part of the frame 24. As an alternative, the tie bar 29 and support 54 can be formed as a single piece.

The support 54 is formed of planar vertical side surfaces 54*a*, 54*b*, top and bottom surfaces 54*c*, 54*d*, and forward and rearward ends 54*e*, 54*f* An axial centerline is defined by the support 54 along the length of the support 54 between the forward and rearward ends 54*e*, 54*f* A pair of the pins 58 extend outwardly from each side surface 54*a*, 54*b* of the support 54. The pins 58 are spaced apart from each other. As shown, the support 54 has a width which is wider than the width of the tie bar 29, but the support 54 and tie bar 29 may have the same width.

Each mounting plate 56 is formed of planar vertical side surfaces 56*a*, 56*b*, top and bottom surfaces 56*c*, 56*d*, and forward and rearward ends 56*e*, 56*f*. A track 60 provided proximate to the bottom surface 56*d* along the outer side surface 56*a* of each mounting plate 56. Each mounting plate 56 has a pair of spaced apart elongated slots 62 provided therethrough. The slots 62 are angled relative to the axis 38 of the ground roller 30, and may be angled at an angle of 30 degrees relative to the axis 38 of the ground roller 30. A vertical slot 64 is provided through each mounting plate 56 at a position proximate to, but spaced from, the forward end 56*e* of the respective mounting plate 56. The slots 62 in the respective mounting plates 56 may align with each other. The slots 64 in the respective mounting plates 56 may align with each other.

The side surfaces 56*b* of the mounting plates 56 abut against a respective side surface 54*a*, 54*b* of the support 54. The pins 58 seat within the respective angled slots 62 on the respective mounting plate 56. As a result, the mounting plates 56 can move forwardly toward the forward end 54*e* of the and upwardly relative to the support 54 as the pins 58 move along the lengths of the slots 62. While the slots 62 are described as being through the mounting plates 56 and the pins 58 provided on the support 54, the slots 62 may be provided in the support 54 and the pins 58 provided on the mounting plates 56.

The second assembly 52 mounts to the first assembly 50 and is moveable relative thereto. The second assembly 52 includes a mounting plate 66, a plurality of wheels 68 rotatably mounted to the mounting plate 66, a plurality of standoffs 70 connected to the mounting plate 66, and a motor engaging block 72.

The mounting plate 66 has first and second spaced apart planar walls 74, each of which is formed of planar vertical side surfaces 74*a*, 74*b*, top and bottom surfaces 74*c*, 74*d*, and forward and rearward ends 74*e*, 74*f* The wheels 68 are connected to the side surfaces 74*b* and the wheels 68 interengage with the track 60. The walls 74 extend downwardly from the mounting plates 56. The mounting plate 66 further has an L-shaped wall having a horizontal leg 76 and a vertical leg 78. The horizontal leg 76 mounts between the side surfaces 74*b* of the walls 74. The vertical leg 78 extends upwardly along the rearward ends 74*f* of the walls 74 and forms an abutment surface 80 which is capable of abutting against the rearward end 54*f* of the support 54. As a result, once the first assembly 50 and the second assembly 52 are engaged by the wheels 68 being seated in the track 60, the second assembly 52 cannot move forwardly relative to the support 54/frame 24.

The standoffs 70 have upper and lower ends. The upper end of each standoff 70 is connected to the lower surface of the horizontal leg 76. The standoffs 70 are formed from an insulating material. The electrode 34 is attached to the lower ends of the standoffs 70.

The motor engaging block 72 is mounted between the mounting plates 56 at their forward ends 56*e* and aligns with the vertical slots 64 in the mounting plates 56. The motor engaging block 72 is formed of side surfaces 72*a*, 72*b*, top and bottom surfaces 72*c*, 72*d*, and forward and rearward ends 72*e*, 72*f* A threaded passageway 82 extends axially through the motor engaging block 72 from the forward end 72*e* to the rearward end 72*f*. Pins 84 extend outwardly from the side surfaces 72*a*, 72*b* and seat within the vertical slots 64 in the mounting plates 56. While the vertical slots 64 are described as being through the mounting plates 56 and the pins 84 provided on the motor engaging block 72, the slots 64 may be provided in the motor engaging block 72 and the pins 84 provided on the mounting plate 56*s*.

The motor 46 is affixed to the end plate 26. The ball screw drive shaft 86 of the motor 46 extends horizontally through a passageway 88 through the end plate 26 and through the passageway 82 through the motor engaging block 72. The drive shaft 86 is threadedly engaged with the motor engaging block 72.

In use, the electrode 34 can be lifted vertically relative to the ground roller 30 by the position adjustment mechanism 36. When the motor 46 is engaged, the ball screw drive shaft 86 rotates which causes the motor engaging block 72 to move forwardly toward the end plate 26. At the same time, the attached mounting plates 56 move forwardly and upwardly as the pins 58 slide along the angled slots 62. To allow for the upward movement, the pins 84 on the motor engaging block 72 slide downwardly along the vertical slots 64. The second assembly 52 is restrained from forward movement by the engagement of the vertical leg 78 of the mounting plate 66 with the rearward end 54*f* of the support 54. As a result, the track 60 slides forwardly relative to the mounting plate 66, but the electrode 34 is lifted vertically when the mounting plates 56 move upwardly. During this movement, the wheels 68 rotate within the tracks 60. Since the motor 46 is used to drive the movement, the electrode 34 can be precisely and quickly positioned proximate to the ground roller 30. For example, the air gap can be set to plus or minus 0.005 of an inch. This accuracy cannot be consistently obtained with manual adjustment or with a hydraulic cylinder.

The position adjustment mechanism 36 includes the sensor 48 and the processing apparatus 400 to effect the automatic adjustment of the electrode 34 relative to the ground roller 30 as described herein. The sensor 48 is positioned proximate to the web 22 prior to the entry of the web 22 into the air gap. The sensor 48 may be a proximity sensor. The processing apparatus 400 is in communication with the sensor 48 and the motor 46 and is used to operate the motor 46.

In use, the ground roller 30 supports the web 22 which is treated as it passes through the air gap between the ground roller 30 and the electrode 34 in a direction transverse to the longitudinal direction of the electrode 34. The air gap between the ground roller 30 and the electrode 34 is normally about 1.5 mm wide and a corona discharge develops in the air gap when the electrode 34 is energized by the power supply to create a high voltage. The surface of the web 22 passing through the air gap is modified by the exposure to the corona so that its printing properties are improved.

When a thickened area 22*a* in the web 22 is sensed by the sensor 48, the sensor 48 sends a signal to the processing apparatus 400 which activates the motor 46 to move the position adjustment mechanism 36 and the electrode 34 mounted thereon away from the ground roller 30 so that the proper air gap spacing is maintained to provide proper treatment to the surface of the web 22. When the sensor 48 senses that the thickened area 22*a* has stopped and an unthickened area 22*b* is sensed by the sensor 48, the sensor 48 sends a signal to the processing apparatus 400 which activates the motor 46 to move the position adjustment mechanism 36 and the electrode 34 mounted thereon to maintain the air gap spacing so that correct treatment is provided to the surface of the web 22. This adjustment occurs very quickly, for example, 120 nanoseconds, and the electrode 34 can be moved approximately one-quarter of an inch relative to the ground roller 30.

Attention is invited to the second embodiment of the corona treatment apparatus 220 shown in FIGS. 6-9 which includes the position adjustment mechanism 236.

The position adjustment mechanism 236 includes an electrode mount 244 which is connected to the frame 24, a motor 46 for moving the position of the electrode 34 relative to the frame 24, a sensor 48, and the processing apparatus 400 in communication with the sensor 48 and the motor 46. The electrode mount 244 is formed from a support 254 mounted between the end plates 26, 28, a pair of spaced apart mounting plates 256 connected to the support 254 and extending downwardly therefrom, and a plurality of insulating standoffs 270 connected to the support 254 and connected to the electrode 34 for supporting the electrode 34 between the mounting plates 256. Each mounting plate 256 may be formed of an upper part 290 and a lower part 292 with the parts 290, 292 being joined together by wheels 294 which ride in tracks 296. The motor 46 is affixed to the end plate 26.

The support 254 has a shaft 298 extending therethrough. An enlarged motor engaging block 372 is provided at each end of the shaft 298. The shaft 298 extends through elongated slots 300 provided through the end plates 26, 28 and the motor engaging block 372 abuts against the respective end plate 26, 28 on the side opposite to the support 254. The motor engaging block 372 has a passageway 304 extending therethrough which is normal to the shaft 298 and parallel to the end plate 26. As such, the position adjustment mechanism 236 and the electrode 34 mounted thereon can be moved upwardly and downwardly relative to the end plates 26, 28 along the distance of the elongated slots 300 to adjust the distance the electrode 34 is relative to the ground roller 30. The support 254 may be rotatable relative to the end plates 26, 28. The support 254 may be formed as a cylinder or tube. The ball screw drive shaft 86 of the motor 46 extends through the passageway 304 through the motor engaging block 372.

When the motor 46 is driven, the ball screw drive shaft 86 rotates which causes the motor engaging block 372 to linearly translate in a vertical direction along the ball screw drive shaft 86. Since the support 254 is attached to the motor engaging block 372, the position adjustment mechanism 236 and its attached electrode 34 translates vertically relative to the ground roller 30. Since the motor 46 is used to drive the movement, the electrode 34 can be precisely and quickly positioned proximate to the ground roller 30. For example, the air gap can be set to plus or minus 0.005 of an inch. This accuracy cannot be consistently obtained with manual adjustment or with a hydraulic cylinder.

The position adjustment mechanism 236 includes the sensor 48 and processing apparatus 400 to effect the automatic adjustment of the electrode 34 relative to the ground roller 30. The sensor 48 is positioned proximate to the web 22 prior to the entry of the web 22 into the air gap. The processing apparatus 400 is in communication with the sensor 48 and the motor 46 and is used to operate the motor 46.

In use, the ground roller 30 supports the web 22 which is treated as it passes through the air gap between the ground roller 30 and the electrode 34 in a direction transverse to the longitudinal direction of the electrode 34. The air gap between the ground roller 30 and the electrode 34 is normally about 1.5 mm wide and a corona discharge develops in the air gap when the electrode 34 is energized by the power supply to create a high voltage. The surface of the web 22 passing through the air gap is modified by the exposure to the corona so that its printing properties are improved.

When the thickened area 22*a* in the web 22 is sensed by the sensor 48, the sensor 48 sends a signal to the processing apparatus 400 which activates the motor 46 to move the position adjustment mechanism 236 and the electrode 34 mounted thereon away from the ground roller 30 so that the proper air gap spacing is maintained to provide proper treatment to the surface of the web 22. When the sensor 48 senses that the thickened area 22*a* has stopped and an unthickened area 22*b* is sensed by the sensor 48, the sensor 48 sends a signal to the processing apparatus 400 which activates the motor 46 to move the position adjustment mechanism 236 and the electrode 34 mounted thereon to maintain the air gap spacing so that correct treatment is provided to the surface of the web 22. This adjustment occurs very quickly, for example, 120 nanoseconds, and the electrode 34 can be moved approximately one-quarter of an inch relative to the ground roller 30.

In each embodiment, if the web 22 is narrow, that is 24" or less, the ground roller 30 and electrode 34 are smaller, and a single motor 46 may be used. In each embodiment, if the web 22 is wide, that is greater than 24", the ground roller 30 and electrode 34 are larger and two motors 46 are used; a motor 46 is provided at each end of the support 54, 254. The second motor 46 is shown in phantom line in the figures. The motor(s) 46 may be a stepper motor or a servo motor. Stepper motors offer several key advantages over other motors, including servo motors, for applications under 2,000 RPM, namely 1) stepper motors provide a larger number of poles and easier drive control, 2) the design of the stepper motor provides a constant holding torque without the need for the motor to be powered, 3) the torque of a stepper motor at low speeds is greater than a servo motor of the same size, and 4) stepper motors have a relatively low cost. For applications where high speed (>2,000 RPM) and high torque is needed, servo motors may be used. A servo motor can supply roughly twice its rated torque for short periods, providing a well of capacity to draw from when needed. In addition, servo motors do not vibrate or suffer from resonance issues at high speed.

FIG. 10 illustrates a block diagram of the processing apparatus 400 that may be implemented on the corona treatment apparatus 20, 220, in accordance with some example embodiments. The processing apparatus 400 may be attached to the frame 24 or may be remote from the frame 24 and communicate wirelessly with the sensor 48 and the motor 46. When implemented on a corona treatment apparatus 20, 220, the processing apparatus 400 enables the corona treatment apparatus 20, 220 to analyze information from the sensor 48 to activate/deactivate the motor 46. It will be appreciated that the components, devices or elements illustrated in and described with respect to FIG. 10 below may not be mandatory and thus some may be omitted in certain embodiments. Additionally, some embodiments may include further or different components, devices or elements beyond those illustrated in and described with respect to FIG. 10.

In some example embodiments, the processing apparatus 400 may include processing circuitry 410 that is configurable to perform actions in accordance with one or more example embodiments disclosed herein. In this regard, the processing circuitry 410 may be configured to perform and/or control performance of one or more functionalities of the corona treatment apparatus 20, 220, such as actuating the roller 30 and the electrode 34, activating the sensor 48 and analyzing the information from the sensor 48 to activate/deactivate the motor 46 in accordance with various example embodiments. The processing circuitry 410 may be configured to perform data processing, application execution and/or other processing and management services according to one or more example embodiments.

In some embodiments, the processing apparatus 400 or a portion(s) or component(s) thereof, such as the processing circuitry 410, may include one or more chipsets and/or other components that may be provided by integrated circuits.

In some example embodiments, the processing circuitry 410 may include a processor 412 and, in some embodiments, such as that illustrated in FIG. 10, may further include memory 414. The processing circuitry 410 may be in communication with or otherwise control a wireless communication interface 416 in communication with the sensor 48 (the sensor 48 may be hard wired to the processing circuitry 410 and/or control module 418.

The processor 412 may be embodied in a variety of forms. For example, the processor 412 may be embodied as various hardware-based processing means such as a microprocessor, a coprocessor, a controller or various other computing or processing devices including integrated circuits such as, for example, an ASIC (application specific integrated circuit), an FPGA (field programmable gate array), some combination thereof, or the like. Although illustrated as a single processor, it will be appreciated that the processor 412 may comprise a plurality of processors. The plurality of processors may be in operative communication with each other and may be collectively configured to perform one or more functionalities of the processing apparatus 400 as described herein. In some example embodiments, the processor 412 may be configured to execute instructions that may be stored in the memory 414 or that may be otherwise accessible to the processor 412. As such, whether configured by hardware or by a combination of hardware and software, the processor 412 capable of performing operations according to various embodiments while configured accordingly.

In some example embodiments, the memory 414 may include one or more memory devices. Memory 414 may include fixed and/or removable memory devices. In some embodiments, the memory 414 may provide a non-transitory computer-readable storage medium that may store computer program instructions that may be executed by the processor 412. In this regard, the memory 414 may be configured to store information, data, applications, instructions and/or the like for enabling the processing apparatus 400 to carry out various functions in accordance with one or more example embodiments. In some embodiments, the memory 414 may be in communication with one or more of the processor 412 and transmission power control module 418 via one or more buses for passing information among components of the processing apparatus 400.

The processing apparatus 400 may further include circuitry, hardware, a computer program product comprising a computer readable medium (for example, the memory 414) storing computer readable program instructions that are executable by a processing device (for example, the processor 412), or some combination thereof. In some embodiments, the processor 412 (or the processing circuitry 410) may include, or otherwise control the transmission power control module 418.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While various embodiments of the invention have been described, it will be apparent to those of ordinary skill in the art that other embodiments and implementations are possible within the scope of the invention. Accordingly, the invention is not to be restricted except in light of the attached claims and their equivalents.

The invention claimed is:

1. A corona treatment apparatus for surface treating a web of material comprising:

a frame;

a rotatable ground roller mounted to the frame;

a mount attached to the frame;

a high-voltage electrode mounted to the mount and mounted proximate to the ground roller;

and a motor directly connected to the mount and configured to adjust the position of the mount and the electrode relative to the frame.

2. The corona treatment apparatus of claim 1, further comprising a sensor configured to sense a thickness of the web of material, and a processor in communication with the sensor and in communication with the motor, the processor configured to activate the motor to adjust the position of the mount and the electrode relative to the frame when a thickened area of the web of material is sensed by the sensor.

3. The corona treatment apparatus of claim 1, further comprising a second motor attached to the mount and configured to adjust the position of the mount and the electrode relative to the frame.

4. The corona treatment apparatus of claim 3, further comprising a sensor configured to sense a thickness of the web of material, and a processor in communication with the sensor and in communication with the motors, the processor configured to activate the motors to adjust the position of the mount and the electrode relative to the frame when a thickened area of the web of material is sensed by the sensor.

5. The corona treatment apparatus of claim 1, wherein the ground roller has an axis around which the ground roller rotates, the mount includes a pair of first mounting plates movably connected to the frame, the first mounting plates being connected to the frame by a pair of pins engaged within elongated angled slots, the slots being angled relative to the axis of the ground roller such that the first mounting plates are moveable relative to the frame in a direction which is angled relative to the axis of the ground roller when the motor is activated, a second mounting plate attached to the first mounting plates, the second mounting plate being moveable relative to the first mounting plates in a direction which is parallel to the axis of the ground roller, the electrode being attached to the second mounting plate.

6. The corona treatment apparatus of claim 5, further including a plurality of wheels mounted between the second mounting plate and the first mounting plates, the wheels being attached to the second mounting plate.

7. The corona treatment apparatus of claim 5, further including a motor engaging block attached to the second mounting plate and through which a drive shaft of the motor extends, the motor engaging block being moveable relative to the first mounting plates.

8. The corona treatment apparatus of claim 7, wherein the motor engaging block is attached to the second mounting plate by a plurality of pins engaged through a slot.

9. The corona treatment apparatus of claim 5, further comprising a second motor attached to the mount and configured to adjust the position of the mount and the electrode relative to the frame.

10. The corona treatment apparatus of claim 9, further comprising a sensor configured to sense a thickness of the web of material, and a processor in communication with the sensor and in communication with the motors, the processor configured to activate the motors to adjust the position of the mount and the electrode relative to the frame when a thickened area of the web of material is sensed by the sensor.

11. The corona treatment apparatus of claim 1, wherein the ground roller has an axis around which the ground roller rotates, the frame has an elongated slot provided therethrough, and the mount includes a support having an end portion extending through the elongated slot in the frame, mounting plates attached to the support and to the electrode, wherein the support, the mounting plates and the electrode can be moved vertically relative to the ground roller when the motor is activated.

12. The corona treatment apparatus of claim 11, wherein the mounting plates comprises a pair of first mounting plates attached to the support, a pair of second mounting plates attached to the first mounting plates, the second mounting plates being moveable relative to the first mounting plates in a direction which is parallel to the axis of the ground roller, the electrode being attached to the second mounting plates.

13. The corona treatment apparatus of claim 12, further including a plurality of wheels mounted between the second mounting plates and the first mounting plates, the wheels being attached to the second mounting plates.

14. The corona treatment apparatus of claim 11, wherein the support is rotatable relative to the frame.

15. The corona treatment apparatus of claim 11, further comprising a second motor attached to the mount and configured to adjust the position of the mount and the electrode relative to the frame.

16. The corona treatment apparatus of claim 15, further comprising a sensor configured to sense a thickness of the web of material, and a processor in communication with the sensor and in communication with the motors, the processor configured to activate the motors to adjust the position of the mount and the electrode relative to the frame when a thickened area of the web of material is sensed by the sensor.

17. A method comprising:

passing a web of material between a ground roller and an electrode, the web of material having a first thickness and a second thickness, the first thickness being greater than the second thickness;

sensing the thickness of the web of material prior to entry of the web of material between the ground roller and the electrode;

upon sensing the first thickness of the web of material, activating a motor to move the electrode a first predetermined distance away from the ground roller; and upon sensing the second thickness of the web of material, activating the motor to move the electrode a second predetermined distance away from the ground roller, the second predetermined distance being less than the first predetermined distance.

18. The method of claim 17, wherein two motors are used to move the electrode.

* * * * *